United States Patent [19]

Saeki et al.

[11] Patent Number: 4,573,230

[45] Date of Patent: Mar. 4, 1986

[54] VERTICALLY MOVING MECHANISM FOR ROTOR BRUSH IN MANUAL CLEANER

[75] Inventors: Kimihiro Saeki, Kashiwa; Kiyoshi Kobayashi, Noda, both of Japan

[73] Assignee: Hukuba Kogyo Kabushiki Kaisha, Japan

[21] Appl. No.: 607,221

[22] Filed: May 4, 1984

[30] Foreign Application Priority Data

May 30, 1983 [JP] Japan ..... 58-81670[U]

[51] Int. Cl.[4] ..... A47L 11/33

[52] U.S. Cl. ..... 15/41 R

[58] Field of Search ..... 15/41 R, 41 A, 41 B, 15/42–45, 48, 49 C, 50 C, 79 R, 79 A, 392

[56] References Cited

U.S. PATENT DOCUMENTS

| | | | |
|---|---|---|---|
| 1,815,225 | 7/1931 | White | 15/49 C |
| 2,166,977 | 7/1939 | Smith | 15/41 R |
| 2,178,917 | 11/1939 | Pullen | 15/41 R |

*Primary Examiner*—Edward L. Roberts
*Attorney, Agent, or Firm*—Jordan B. Bierman

[57] ABSTRACT

A mechanical cleaner for carpets or floors comprising a main casing having driving wheels which protrude through an open bottom and are rotatable by movement of the cleaner. A rotatable brush, driven by the wheels, is adapted to brush dust from the carpet or floor into a dust box on the main casing. A vertically moveable means for releasably mounting the brush comprises a pair of swinging frames, one end of each of which is rotatably journaled on the casing at a point spaced apart from the other swinging frame. The brush is rotatably mounted between the ends of the frames opposite the location of the journals and are urged downwardly. There is an engaging means on the casing which will releasably engage the frames and limit their downward movement. As a result, releasing the engaging means permits the frames carrying the brush to rotate downwardly to allow the brush to be detached and replaced by a new brush.

2 Claims, 3 Drawing Figures

VERTICALLY MOVING MECHANISM FOR ROTOR BRUSH IN MANUAL CLEANER

BACKGROUND OF THE INVENTION

1. Field of the Invention

This invention relates to a mechanism for moving vertically a rotor brush in manual cleaners.

2. Description of the Prior Art

Heretofore, a rotor brush in manual cleaners has generally been journaled fixedly on its cleaner main body and therefore, there has been such problem that such type of cleaners cannot adjust sufficiently to various pile lengths of carpets. More specifically, such a cleaner wherein the rotor brush has been adjusted ideally to a short pile length of carpets has reduced cleaning effect as well as excessive resistance with respect to carpets having longer pile lengths, because bristles of the rotor brush are too bendable for the latter carpets. In this respect, means for suitable setting positions of rotor brushes by the operation of levers, dials and the like have been developed. However, this type of brush has such disadvantages that troublesome adjustment is required each time in accordance with specifications of carpets to be cleaned, and the construction of the cleaners becomes complicated so that such cleaners become expensive.

Under such background as mentioned above, a mechanism having such construction as shown in FIG. 1 wherein its rotor brush moves automatically in vertical direction dependent upon a depth of the piles of carpets to be cleaned has already been proposed.

Referring specifically to FIG. 1, the complementary half of the integral whole mechanism is shown in the drawing wherein a rotor brush holder 32 is inserted into slide grooves, each having ⊐-shaped section, of a guide piece 31 which is integrally assembled with a main body casing 16 through a mount 30, said rotor brush holder 32 is urged toward the ground (the downward direction in the drawing) by means of a wire spring 33 connecting said guide piece 31 with said rotor brush holder 32 and at the same time, said rotor brush holder 32 defines the limitation for sliding said rotor brush in the vertical direction. Thus, the rotor brush 40 is rotatably mounted by positioning an end portion of a shaft 13 into a hole 34 bored on the rotor brush holder 32.

In the construction as described above, the rotor brush exhibits also sufficient movement in the vertical direction, but there is such disadvantage that if dust deposits on a sliding portion which is defined by the guide piece 31 and the rotor brush holder 32, smooth vertical movement is prevented by such dust deposited.

In other words, a conventional vertically moving mechanism for a rotor brush in manual cleaners has been constructed in such that a rotor brush holder for supporting the rotor brush slides in slide grooves disposed vertically to perform the vertical motion. In a manner according to the above conventional mechanism, however, there is such a disadvantage that the vertical motion of the rotor brush holder is hindered by dust in the case when such dust becomes accumulated in slide grooves. Besides, in case of releasing the rotor brush, there is such a disadvantage that the rotor brush must be taken out by forcibly expanding sidewards the rotor brush holder so that the releasing of the rotor brush is difficult and requires a comparatively strong force.

SUMMARY OF THE INVENTION

It is an object of the invention to provide a vertically moving mechanism for a rotor brush in manual cleaners by which such disadvantages as described above in conventional mechanisms can be eliminated and in which the rotor brush can be moved vertically without providing slide grooves so that trouble due to dust can be avoided, and in addition the rotor brush is easily attached and detached.

This and other objects of the invention will be apparent from the following detailed description of an illustrative embodiment of the invention, taken together with the accompanying drawings.

DETAILED DESCRIPTION OF THE INVENTION

An embodiment of the present invention will be described hereinbelow by referring to the accompanying drawings.

Figure 1:
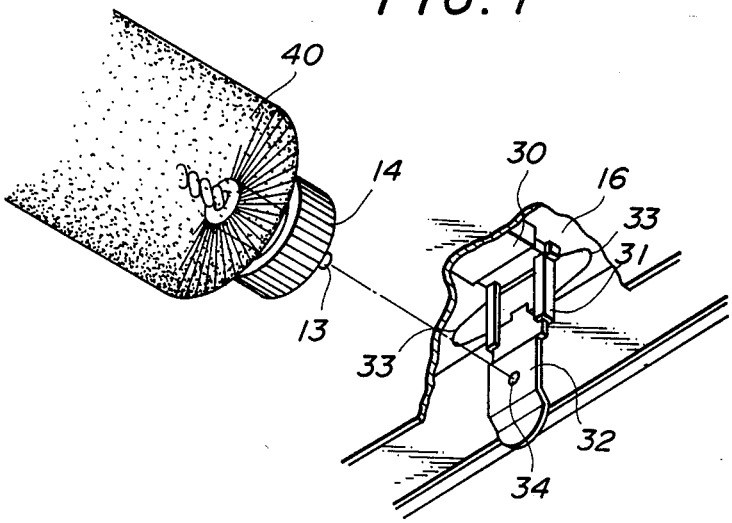
FIG. 1 is an explanatory view showing a conventional automatically vertically moving mechanism for a rotor brush.
Figure 3:
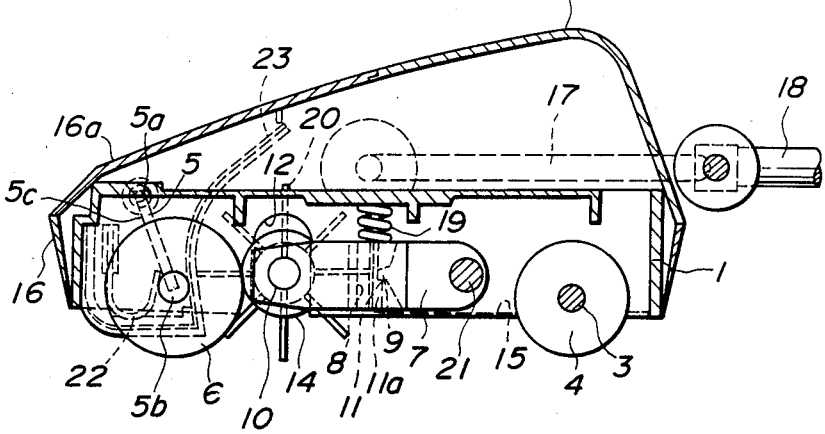
FIG. 3 is a sectional view taken along line III—III of FIG. 2.
Figure 2:
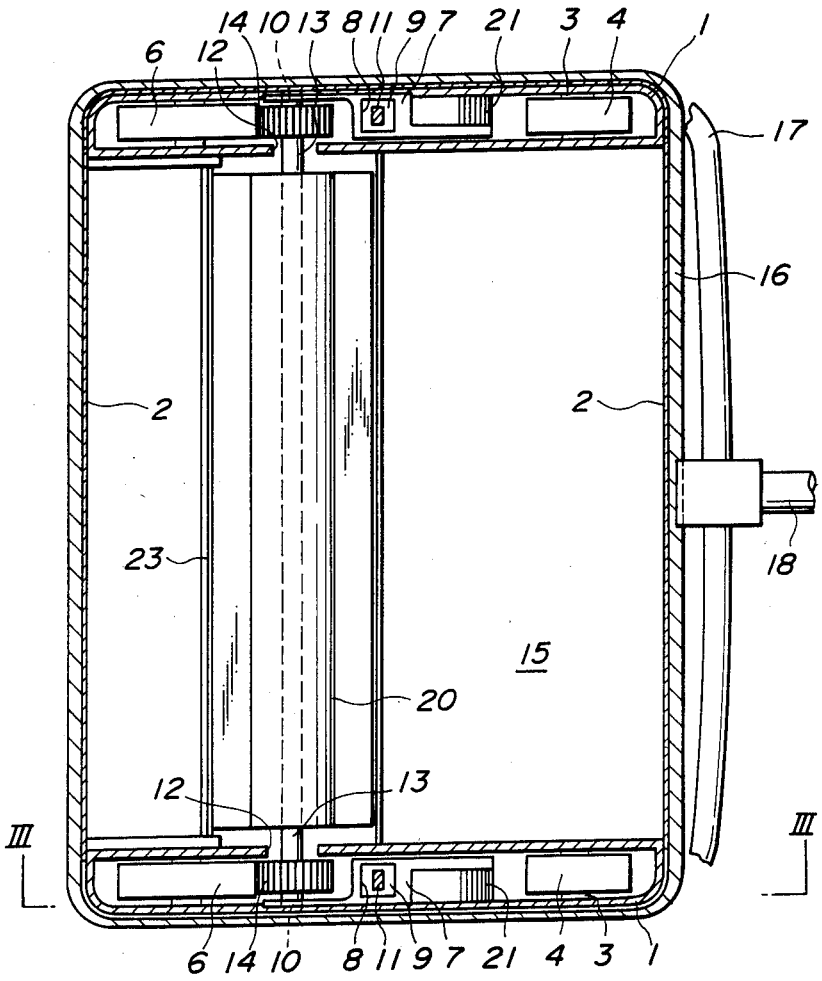
FIG. 2 is a bottom view showing the manual cleaner according to the present invention.

FIGS. 2 and 3 show the manual cleaner according to the present invention wherein a pair of rectangular roller containing cases 1, 1 each bottom of which is opened are disposed opposite to each other, and each opposite end of both the roller containing cases 1, 1 is connected to the corresponding opposite end of the other case by means of a connecting piece 2, respectively. Inside each roller containing case 1, a wheel 4 is rotatably supported by a shaft 3 in the rear of the cleaner which correponds to the side to which a handle 18 is to be attached such that the lower part of the wheel 4 protrudes from the under surface of the case 1. In the front of and inside each roller containing case 1, a driving wheel 6 is rotatably mounted on a ⊐-shaped shaft 5 so as to be swingable substantially forwardly and backwardly. More specifically, a horizontal portion **5*a* of the ⊐-shaped shaft 5 is inserted revolvably into a hole bored on the upper part of the roller containing case 1, whilst the other horizontal portion 5*b* is provided with said driving wheel 6 so that the driving wheel 6 can swingingly be moved by means of a vertical portion 5*c* with the horizontal portion 5*a* as the center. In addition, since the horizontal portion 5*b* passing through said driving wheel 6 is pressed by a pressing spring 22 disposed in the roller containing case 1, said driving wheel 6 is always urged so as to swing in a rearward and slightly upper direction. In the central part of said roller containing case 1, the rear end portion of a swinging frame 7 is journaled through a shaft 21. The swinging frame 7 is provided with a vertical through-hole 8 at the central portion thereof as well as an engaging projection 9 so as to project towards the front of the cleaner on the inner surface of the rear side of the through-hole 8. Furthermore, a hole 10 for the undermentioned rotor brush 20 is defined on the front end portion of the swinging frame 7**.

An engagement projecting piece 11 having an engaging portion 11*a* being capable of engaging with the engaging projection 9 formed inside the through-hole 8 is suspended from the under surface of the upper plate of the roller containing case 1 at the portion corresponding to the through-hole 8 of the swinging frame 7, and the extreme end portion of said engagement projecting piece 11 is inserted into said through-hole 8. Further, the engagement projecting piece 11 is surrounded by a spring 19 disposed in between the swinging frame 7 and the upper plate of the roller containing case 1, so that the swinging frame 7 is always urged downwardly.

Each notched portion 12 being elongated vertically is defined on case 1 which contains the wheel 4, the driving wheel 6 and the swinging frame 7 therein as described above at the portion corresponding to the rotor brush hole 10. The opposite ends of a shaft 13 for the rotor brush 20 are positioned in the holes 10 of both the swinging frames 7, 7 through both the notched portions 12, 12 respectively, whereby the rotor brush 20 is rotatably held between the swinging frames 7, 7 each being disposed inside the roller containing case 1 so as to be swingable in up and down directions. In the present embodiment, the rotor brush 20 is provided with a plurality of flexible blades extending radially from the circumference of the shaft 13 for the rotor brush 20 and in this case, one end of each blade is fixed to said circumference of the shaft 13.

A part of the shaft 13 being positioned in said roller containing case 1 is provided with a driven wheel 14 in forcible contact with said driving wheel 6.

A dust box 15, having a flat bottom apart from a floor with a prescribed distance as well as a ceiling part 15*a* being a part of a ceiling board of the manual cleaner, is formed in the rear of the cleaner in between the roller containing cases 1, 1 constructed as described above. In the front of the cleaner formed between the roller containing cases 1, 1 a guide plate 23 for dust which is gradually bent rearwards with upward extension thereof is disposed. Both the roller containing cases 1, 1 are covered with a main body casing 16 provided with a main body ceiling part 16*a* forming integrally the ceiling board together with said ceiling part 15*a* of the dust box 15, and the bottom of said main body casing is open. Opposite ends of a ⊐-shaped handle arm part 17 are rotatably mounted on both right and left sides of the main body casing 1, and at the same time the handle 18 is attached to the handle arm part 17 at the central portion thereof.

Operation of the manual cleaner according to the present invention constructed as described above will be explained hereinbelow.

In assembled condition of the manual cleaner, since each driving wheel 6 is urges rearwards and upwardly by means of each pressing spring 22, the driving wheel 6 is forcibly contacted with a driven wheel 14 mounted on an end of the shaft 13 for the rotor brush 20. Thus, when an operator moves the manual cleaner on a floor, the wheel 4, 4 and the driving wheels 6, 6 roll, respectively, whereby the driven wheels 14, 14 are rotated so that the rotor brush 20 rotates and each blade springs up dust on the floor to receive it in the dust box 15. In this case, a downward urging force due to each spring 19 is larger than force produced by kicking the floor with each blade and which directs upwardly each swinging frame. As a result, all blades of rotor brush 20 contact the floor or carpet, so that dust on the floor can effectively be led into the dust box 15. The dust once sprung up by the respective blades does not return to the floor by means of the action of the guide plate 23, whereby positive cleaning can be effected by the manual cleaner according to the present invention.

After the manual cleaner of the invention was employed for a certain period of time, the rotor brush 20 mounted between the swinging frames 7, 7 can be simply detached by the following manner.

First, when the engagement projecting pieces 11, 11 suspended from the under surface of the upper plate of the roller containing cases 1, 1 are pushed forwardly, the engaging projections 9, 9 formed inside the through-holes 8, 8 of the swinging frames 7, 7 release the engaging portions 11*a*, 11*a* of the engagement projecting pieces 11, 11, so that the swinging frames 7, 7 swing downwardly with the shafts 21, 21 as their centers, respectively, whereby the rotor brush 20 is detached from the cleaner. On the other hand, when a fresh rotor brush 20 is mounted bewtween the swinging frames 7, 7 and then the brush is pushed upwardly, each engagement projecting piece 11 passes through the corresponding through-hole 8, and then each engaging portion 11*a* of the engagement projecting piece 11 engages with each engaging projection 9 formed inside the through-hole 8 so that the manual cleaner ready for use as shown in Fig. 2 and 3 is prepared.

Since the manual cleaner according to the present invention is constructed as described above, the following excellent advantages can be attained.

Even if a substantial amount of dust has been accumulated in the cleaner, smooth vertical motion of the rotor brush can be ensured.

In case of detaching the rotor brush, since the swinging frames are swingably moved downwardly, there is no need for opening sidewards such frames so that a used rotor brush can easily be detached to replace it by a fresh rotor brush.

What is claimed is:

1. A mechanical cleaner comprising a main casing having driving wheels and an open bottom, said wheels projecting downward from said open bottom and being rotatable, a rotatable brush driven by said wheels and adapted to brush dust from a carpet or floor into a dust box on said main casing.

vertically movable means for releasably mounting said brush comprising a pair of swinging frames one end of each of which is rotatably journaled on said casing at a point spaced apart from the other frame, said brush being rotatably mounted between the other ends of said frames, said frames being urged downwardly by at least one urging means, at least one engaging means on said casing and adapted to releasably engage said frames, whereby releasing said engaging means permits said frames carrying said brush to rotate downwardly to allow said brush to be detached from said frames.

2. The cleaner of claim 1 wherein said urging means is at least one spring bearing between said casing and said frame.

* * * * *